United States Patent [19]

Lüth

[11] 3,998,073

[45] Dec. 21, 1976

[54] SELECTION DEVICE FOR OSCILLATING JACKS IN A CIRCULAR KNITTING MACHINE

[75] Inventor: Claus-Peter Lüth, Florence, Italy

[73] Assignee: Macchine Tessili Circolari-Matec S.P.A., Rome, Italy

[22] Filed: Aug. 15, 1975

[21] Appl. No.: 605,205

[30] Foreign Application Priority Data

Aug. 20, 1974 Italy ..... 9551/74

[52] U.S. Cl. ..... 66/50 R

[51] Int. Cl.[2] ..... D04B 9/00

[58] Field of Search ..... 66/50 R, 154 A

[56] References Cited

UNITED STATES PATENTS

| | | | |
|---|---|---|---|
| 3,811,297 | 5/1974 | Hamma | 66/50 R |
| 3,815,383 | 6/1974 | Hamma | 66/50 R |
| 3,855,819 | 12/1974 | Sawazaki | 66/50 R |

*Primary Examiner*—Mervin Stein
*Assistant Examiner*—Andrew M. Falik
*Attorney, Agent, or Firm*—Haseltine, Lake & Waters

[57] ABSTRACT

A selection device for oscillating jacks in a circular knitting machine comprising selection levers pivotal between an active position in which the jacks are radially thrust by a thrust profile of the levers, and an inactive position. The levers are moved into one of these positions by engagement of a control profile of the levers by the butts and are held in this position by a permanent magnet. The flux of the magnet can be neutralized temporarily by program-controlled windings to permit release of a selected lever whereby the lever is moved into its other position by means of a bias.

4 Claims, 20 Drawing Figures

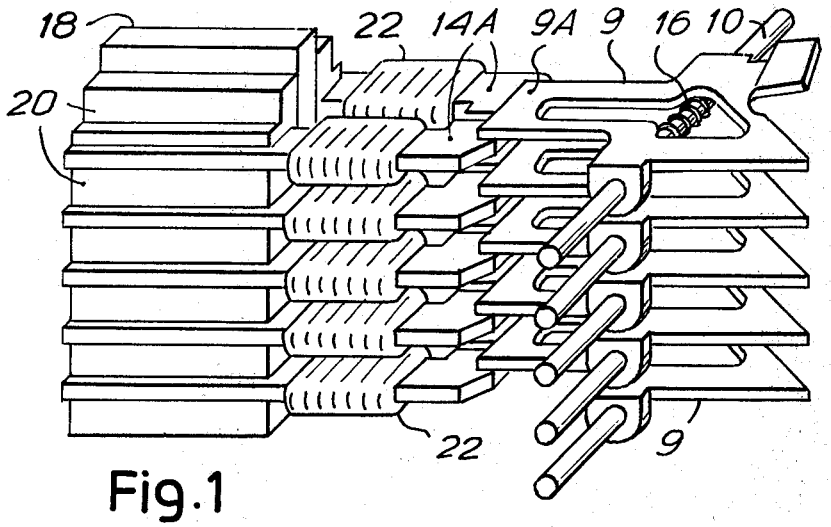
Fig.1
Fig. 2
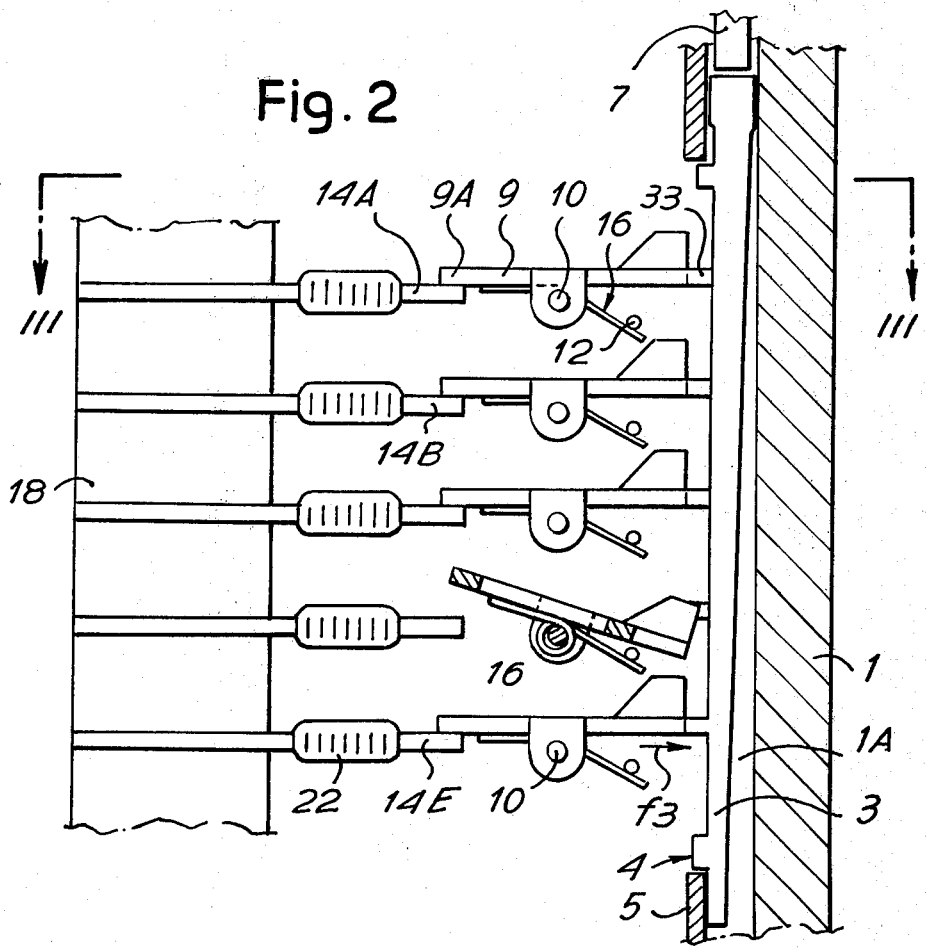

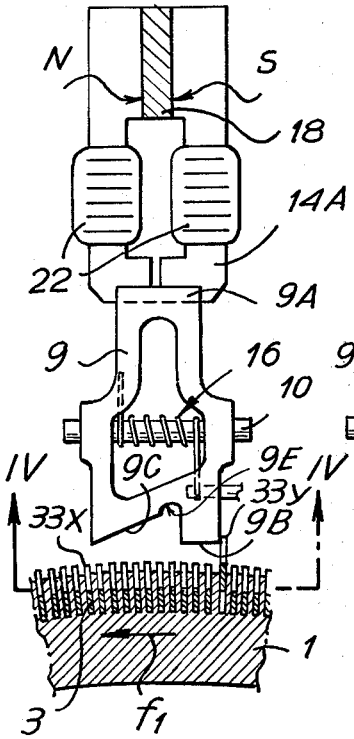
Fig.3
Fig.5
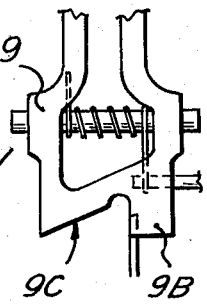
Fig.7
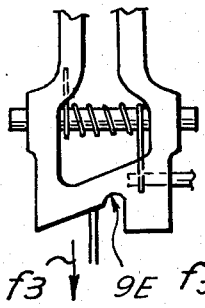
Fig.9
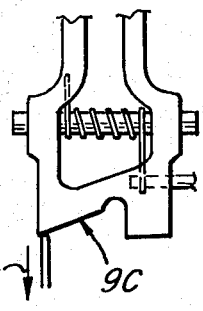
Fig.4
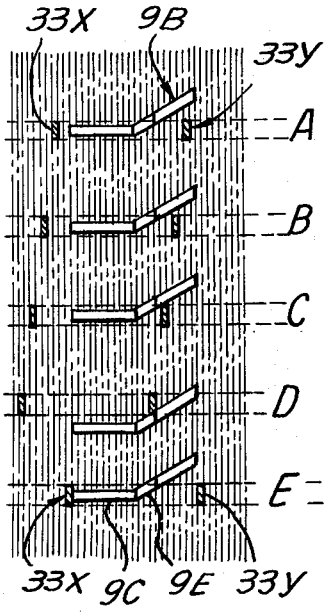
Fig.6
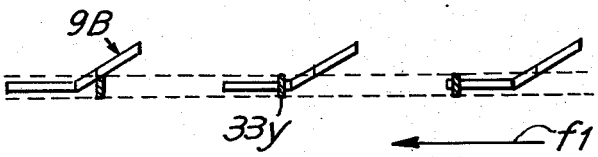
Fig.8
Fig.10

SELECTION DEVICE FOR OSCILLATING JACKS IN A CIRCULAR KNITTING MACHINE

BACKGROUND OF THE INVENTION

1. Field of the Invention

The present invention relates to circular knitting machines, and more particularly to a selection device for selecting oscillating jacks of a circular knitting machine.

2. Description of the Prior Art

There have been proposed selection devices for oscillating jacks which involve the use of permanent magnets, of electro-magnets, and also of control projections on the needle cylinder to move the selectors. Such previously proposed devices are difficult to maintain and are relatively large and expensive to produce.

SUMMARY OF THE INVENTION

According to the invention, there is provided in a circular knitting machine, a needle cylinder containing grooves, an oscillating jack in each said groove, said jack having a butt, and a jack selection device, said device comprising a selector lever pivotal between an active position and an inactive position, said lever having a radial thrust profile co-operating with said butts in the active position of the lever to urge the butts radially, and said lever having a control profile co-operating with said butts such that the butts cause the lever to pivot in a first direction towards one of said positions, said control profile being located before the thrust profile whereby the butts can act on the control profile before the thrust profile and said control profile being spaced from the thrust profile by such a distance that the lever can be pivoted while a said butt is located between the profiles, bias means arranged to apply a pivotal bias to said lever in a direction opposite to said first direction, permanent magnet means operative to retain magnetically the lever in said one position, and electromagnetic winding means operative to said temporarily neutralize the flux of said magnet means whereby said lever can be moved from the said one position towards the other position by bias means, said winding means being program-controlled.

BRIEF DESCRIPTION OF THE DRAWINGS

An embodiment of the invention will now be described, by way of example only, with reference to the accompanying diagrammatic drawings, in which:

FIG. 1 is a perspective view of a selection device in accordance with the present invention;

FIG. 2 is a side elevation showing the device and part of a needle cylinder;

FIG. 3 is a section taken on line III—III of FIG. 2;

FIG. 4 is a section taken on line IV—IV of FIG. 3;

FIGS. 5 and 6; 7 and 8; 9 and 10; 11 and 12; 13 and 14; 15 and 16; 17 and 18; and 19 and 20 are simplified schematic views similar to those of FIGS. 3 and 4 and showing a selection lever during phases of its operation.

DESCRIPTION OF THE PREFERRED EMBODIMENTS

Figures 11, 13, 15:
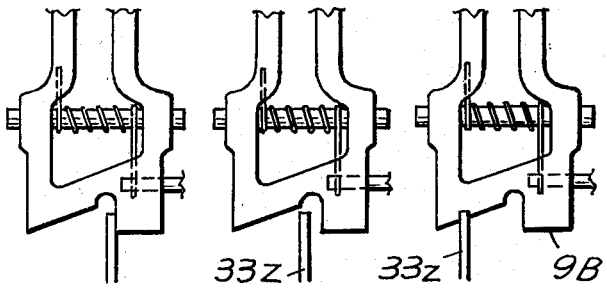

As shown in the accompanying drawings, a needle cylinder 1 of a circular knitting machine is provided with longitudinal grooves or tricks 1A which contain conventional oscillating jacks 3 for instance as shown in U.S. Pat. Nos. 3,461,690 and 3,530,686 and in German Offenlegungschrift No. 2,117,713. The oscillating jacks 3, which have lower butts 4, may be moved upwardly in the grooves 1A under the control of a lower cam 5 and may oscillate in a radial plane, such that their lower ends are urged radially outwardly, for example by centrifugal force, to assume a position in which the butts 4 are lifted by the operation of the cam 5. Those jacks 3 which are selected not to be lifted by the cam 5, are urged radially inwardly by means of a thrust exerted on butts 33 of these jacks so that the butts 4 of these jacks are not engaged by the cam 5. The lifting of a jack 3 determines the raising of a corresponding jack 7 and thus of a corresponding needle (not shown) of conventional type.

In order to obtain a required needle selection, the oscillating jacks 3 are individually controlled. For this purpose there are several horizontal rows of butts 33 arranged at different heights. The jacks 3 are divided into groups each consisting of several jacks.

In the embodiment shown, each group consists of twelve jacks, and twelve rows of butts are provided so that in each group, the butts of the respective jacks each lie in a different one of the twelve rows; in FIG. 4, five of the twelve rows of butts are shown and are designated A to E. The groups or jacks may include more than twelve jacks to obtain an increased distance between the adjacent butts of the same row.

In correspondence with each row of butts, there is provided a selector in the form of an oscillatory lever 9; preferably window-like apertures are provided in the levers 9 to reduce the weight thereof and therefore the inertia. Each lever 9 is pivotal about a central pivot 10 between two limit positions; one of these positions is defined by engagement of one end of the lever with a limit-switch 12 schematically shown in FIG. 2 — the other of these positions is defined by the engagement of the other end 9A of the lever 9 with corresponding pairs of pole pieces 14A, 14B . . . of a magnet 18 to be described hereinafter.

The limit position defined by the limit-switch 12 is reached under the bias of a small spring 16, which may be a helical spring wound on the pivotal axis 10. In this position the end of the lever 9 remote from the end 9A is in a lowered position in front of the butts 33 of the jacks 3 in the corresponding row of butts; this is the inactive position. In the other limit position, the end 9A of the lever 9 rests on the pair of pole pieces, these pole pieces being arranged side by side; this is the active position of the lever in which the butts 33 of the corresponding row are thrust radially inwardly. Movement of the lever 9 into its active position is effected by the movement of cylinder 1 as will be described hereinafter, and the lever 9 is maintained in its active position by a magnetic retaining effect of relatively low force; a high magnetic force is not required since the force simply acts to retain the end 9A of the lever 9, after this end has been moved towards the pole pieces and is substantially in contact therewith. The pole pieces 14A, 14B . . . are connected to a single permanent magnet 18 by means of supports 20 and are composed of a magnetically mild material for instance pure iron. On each pole piece of each pair, there are provided two windings 22 which can be selectively energized as determined by a program, such a program in effect forming a needle control program. The permanent magnet 18 has N and S polarities on its opposite faces, as indicated in FIG. 3, and each pole piece of each pair of pole pieces is associated with a respective one of the poles of the magnet and carries the magnetic flux to retain the end 9A of the lever 9 in its active position. When the windings 22 of one pair of pole pieces are energized, they induce in the corresponding pole pieces a magnetic flux in the reverse direction to neutralize the flux produced in these pole pieces by the magnet 18; thus the magnetic retaining effect on the end 9A of the associated lever 9 is released and the lever 9 is returned by its spring 16 into its inactive position in contact with limit switch 12.

Each lever 9 has, at its end opposite the end 9A, two subsequent cam profiles 9B and 9C which are spaced in the direction of rotation $f_1$ of the butts 33 of the jacks 3 and thus of the needle cyliner 1, the space between the profiles 9B and 9C being designated 9E. The profile 9B is inclined downwardly (as viewed in FIG. 4) towards the space 9E, that is in the direction of movement of the butts 33. The profile 9C is inclined radially inwardly to thrust the butts 33 inwardly towards the needle cylinder 1 as indicated by arrow $f_3$. The profile 9B is a control profile which effects movement of the lever 9 from its inactive position into its active position.

Considering more particularly FIGS. 3 to 10, the lever 9 shown therein is in its active position in which it urges the butts 33 of its associated row of butts, inwardly with respect to the needle cylinder whereby to prevent lifting of the associated jacks 3 by the cam 5. In FIGS. 3 and 4, one butt 33X of the row has just passed the profile 9C of the lever 9 and the following butt 33Y of the same row is about to enter the zone of the lever 9. It is to be noted that the number of jacks between subsequent butts provided in the same row, such as those denoted by 33X, 33Y, depends on the dimensions of the profiles 9B, 9C, and on the space 9E in the direction of motion of the butts as indicated by the arrow $f_1$; further, the adjacent butts of each row are spaced by a distance equal at least to the distance spanned between the start of the profile 9B and the end of the profile 9C. The lever 9 is located in its raised active position, in which the profile 9B is located above the rectilinear trajectory of the butts such as those denoted by 33X, 33Y, while the profile 9C, which is inclined to act in the radial direction with respect to the needle cylinder is located at the level of the trajectory of the butts of the considered row. Under these conditions, the butt 33Y passes under the profile 9B (FIGS. 5 and 6), passes beyond the space 9E, and then engages the profile 9C so that it is moved by the profile 9C radially inwardly in the direction of the arrow $f_3$ (FIGS. 7 and 9). Thus, the corresponding jack 3 is pivoted inwardly such that its butt 4 is moved out of the path of action of the cam 5 and the jack 3 is not lifted. This action is repeated for subsequent butts in the row, provided the windings 22 of the corresponding pair of pole pieces remain unenergized.

Figures 12, 14, 16:
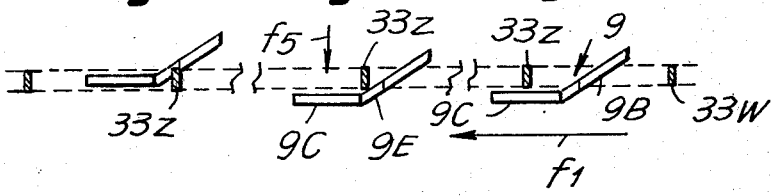
Figures 17, 19:
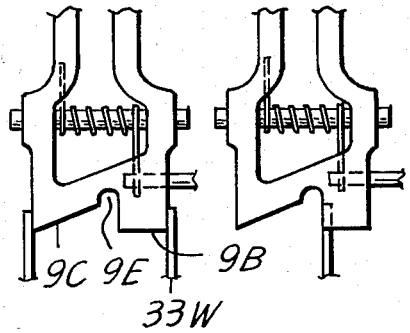
Figures 18, 20:
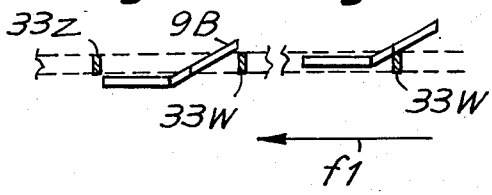

If a jack 3 is to be lifted, it must not be urged inwardly. For this purpose when the butt 33Z associated with the jack reaches the space 9E (FIGS. 11 and 12), a brief energization of the windings 22 is effected in such a manner that the magnetic retaining effect on the lever 9 ceases and the latter is urged by the spring 16 from its raised active position (FIG. 12) into its lower inactive position position (FIG. 14) in the direction of the arrow $f_5$ of FIG. 14. In the inactive position of the lever 9 (FIGS. 14, 16 and 18) the butt 33Z passes above the profile 9C and is therefore not urged radially inwardly. Thus the butt 4 of the associated jack 3 will remain in the path of cam 5 to be raised thereby. The subsequent butt 33W (FIGS. 17 to 20) comes under the profile 9B after the butt 33Z has passed beyond the zone of the profile 9C. The butt 33W contacts the lower inclined surface of the profile 9B and raises the profile 9B as the butt 33W advances along the profile. In this manner, the lever is lifted from its inactive position of FIG. 16 to its active position of FIG. 20, this movement being derived simply from the rotational movement of the butt 33W and thus of the needle cylinder. Thereafter, if the butt 33W is to be urged inwardly, the windings 22 remain unenergized whereby the flux of the permanent magnet retains the lever in its active position of FIG. 20 and the operation described with reference to FIGS. 3 to 10 is repeated; if, on the contrary, the butt 33W is not to be urged inwardly, the windings 22 are briefly energized and the action described with reference to FIGS. 11 to 18 is repeated whereby the butt 33W remains in its radially outer position and the associated jack 3 is raised.

As described above it is apparent that each butt 33 can act to lift the lever 9 and can be urged radially inwards by the same lever.

The selection device particularly described offers many advantages with respect to the previously proposed devices. In particular, when the profile 9C acts on the butt 33 it needs to be stabilized in its position by only a very weak spring since the re-action of the butt on the profile 9C is absorbed not through the spring but through the pivot 10. Consequently the spring 10 is much weaker than would be necessary if it was required to provide a thrust designed to support the contrary thrust of the butts subjected to a centrifugal effect during the rotation of the needle cylinder. The lever 9 has only a very small mass, which, together with the small force of the spring, enables rapid movements to be made. This contrasts with the device described in U.S. Pat. No. 3,530,686, wherein permanent magnets are moved with the lever. The permanent magnet 18 need only be of relatively low power since it does not serve to attract the lever at a distance but simply serves to retain the lever in its active position after the lever has been moved into this position. The magnetic flux can be neutralized with electromagnetic windings which may also be very weak and thus inexpensive and of small size.

The arrangement described also permits the magnet to be formed from a plurality of individual magnets stacked in a single vertical row.

Moreover, the levers are identical and can be easily produced.

Consequently, the device particularly described is of small size, and low cost, and has a high operation speed.

The device is used with a needle cylinder of conventional construction and with butts which do not have a high susceptability to breakdown or failure. The butts 4 on the jacks are of conventional construction and are easy to replace in case of failure.

The device can be used in circular knitting machines for knitting hoisery with fine needles, a small pitch between the needles (32 to 36 needles per inch) and high peripheral speeds of the cylinder (over 90 meters/minute).

It will also be noted that the low power of the magnets and the short times of energization of the electromagnetic windings facilitate a low electric power consumption with a consequently low dissipation of heat.

What is claimed is:

1. In a circular knitting machine a needle cylinder containing grooves, an oscillating jack in each said groove, said jack having a butt, and a jack selection device comprising a selector lever pivotal between an active position and an inactive position, said lever having a radial thrust profile co-operating with said butts in the active position of the lever to urge the butts radially, said lever having a control profile co-operating with said butts such that the butts cause the lever to pivot in a first direction towards one of the said positions, said control profile being located before the thrust profile whereby the butts act on the control profile before the thrust proflie, said control profile being spaced from the thrust profile by such a distance that the lever can be pivoted while one said butt is located between the profiles, bias means including spring means for applying a pivotal bias to said lever in a direction opposite to said first direction, permanent magnet means for magnetically retaining the lever in said one position, and electromagnetic winding means for temporarily neutralizing the flux of said magnet means whereby said lever can be moved from the said one position towards the other position by said bias means, said winding means being program-controlled, the engagement of the control profile by a butt causing the lever to move into its active position such that the thrust profile can then engage the said butt, the permanent magnet means being arranged to hold the lever in its active position while the bias means is arranged to pivot the lever into its inactive position upon neutralization of the flux of the permanent magnet means.

2. A knitting machine as claimed in claim 1, wherein the lever has opposed end portions, the profiles being located at one end portion of the lever, the other end portion of the lever co-operating with the permanent magnet means, the lever being pivotal about an axis intermediate its end portions.

3. A knitting machine as claimed in claim 1, wherein said selection device further comprises a plurality of said selector levers arranged in vertically spaced relationship, the permanent magnet means comprising a single permanent magnet, and a plurality of pairs of pole pieces each associated with the magnet and a respective one of the levers such that the lever engages the pole pieces in its said one position, and the winding means comprises individual windings on the pair of pole pieces.

4. A knitting machine as claimed in claim 1, wherein said selection device further comprises a plurality of said levers, the butts of the jacks being arranged in a plurality of horizontal rows, each said lever being associated with a respective row of butts, the adjacent butts of each row being spaced by a distance equal to at least the distance between the start of the control profile and the end of the thrust profile, the number of jacks subtended between adjacent butts of the same row being equal to the number of rows of butts whereby the selection device can act on each of the jacks in the needle cylinder.

* * * * *